US009023272B2

(12) United States Patent
Yoshimura et al.

(10) Patent No.: US 9,023,272 B2
(45) Date of Patent: May 5, 2015

(54) COPPER-ZINC ALLOY PRODUCT AND PROCESS FOR PRODUCING COPPER-ZINC ALLOY PRODUCT

(75) Inventors: Yasuharu Yoshimura, Toyama (JP); Takuya Koizumi, Toyama (JP); Koichi Mikado, Toyama (JP); Takahiro Fukuyama, Toyama (JP); Atsushi Ogihara, Toyama (JP)

(73) Assignee: YKK Corporation (JP)

( * ) Notice: Subject to any disclaimer, the term of this patent is extended or adjusted under 35 U.S.C. 154(b) by 221 days.

(21) Appl. No.: 13/808,298

(22) PCT Filed: Jul. 5, 2010

(86) PCT No.: PCT/JP2010/061377

§ 371 (c)(1), (2), (4) Date: Jan. 4, 2013

(87) PCT Pub. No.: WO2012/004841

PCT Pub. Date: Jan. 12, 2012

(65) Prior Publication Data

US 2013/0104349 A1 May 2, 2013

(51) Int. Cl.

| | |
|---|---|
| ***C22C 9/00*** | (2006.01) |
| ***C22C 9/04*** | (2006.01) |
| ***C22F 1/08*** | (2006.01) |
| ***A44B 19/26*** | (2006.01) |
| ***B21D 53/50*** | (2006.01) |
| ***C22F 1/00*** | (2006.01) |

(52) U.S. Cl.

CPC ... *C22C 9/04* (2013.01); *C22C 9/00* (2013.01); *C22F 1/08* (2013.01); *A44B 19/26* (2013.01); *B21D 53/50* (2013.01); *C22F 1/00* (2013.01)

(58) Field of Classification Search

None

See application file for complete search history.

(56) References Cited

U.S. PATENT DOCUMENTS

| | | | | | |
|---|---|---|---|---|---|
| 3,403,997 | A | * | 10/1968 | Badia | 420/479 |
| 4,014,716 | A | * | 3/1977 | Cabo et al. | 148/563 |
| 4,055,445 | A | * | 10/1977 | Pops | 148/554 |
| 4,101,317 | A | * | 7/1978 | Okano | 148/433 |
| 4,683,175 | A | * | 7/1987 | Bakewell et al. | 428/677 |
| 4,944,915 | A | * | 7/1990 | Kim et al. | 420/479 |

(Continued)

FOREIGN PATENT DOCUMENTS

| | | | |
|---|---|---|---|
| CN | 1542150 | A | 11/2004 |
| EP | 0947592 | A1 * | 10/1999 |

(Continued)

OTHER PUBLICATIONS

Machine translation of JP-2000-355746A (no date available).*

(Continued)

*Primary Examiner* — Kiley Stoner

(74) *Attorney, Agent, or Firm* — Kilpatrick Townsend & Stockton LLP

(57) ABSTRACT

A copper-zinc alloy product of the invention contains zinc in an amount of higher than 35% by weight and 43% by weight or less and has a two-phase structure of an α-phase and a β-phase. Further, the ratio of the β-phase in the copper-zinc alloy is controlled to be higher than 10% and less than 40% and the crystal grains of the α-phase and the β-phase are crushed into a flat shape and arranged in a layer shape through cold working. According to the copper-zinc alloy product, it is possible to decrease the copper content and to appropriately secure the strength and cold workability by appropriately controlling the ratio of the β-phase.

15 Claims, 8 Drawing Sheets

(56) References Cited

U.S. PATENT DOCUMENTS

| | | | | |
|---|---|---|---|---|
| 5,637,160 | A * | 6/1997 | Brock et al. | 148/434 |
| 6,458,222 | B1 * | 10/2002 | Matsubara et al. | 148/433 |
| 2002/0159912 | A1 * | 10/2002 | Oishi | 420/477 |
| 2003/0003319 | A1 * | 1/2003 | Doujak et al. | 428/646 |
| 2003/0095887 | A1 * | 5/2003 | Dong | 420/470 |
| 2004/0136860 | A1 * | 7/2004 | Fujita et al. | 420/482 |
| 2005/0039827 | A1 * | 2/2005 | Yamagishi et al. | 148/554 |
| 2005/0092401 | A1 * | 5/2005 | Oishi | 148/434 |
| 2005/0230014 | A1 * | 10/2005 | Ishida et al. | 148/683 |
| 2006/0065336 | A1 * | 3/2006 | Gillieron et al. | 148/707 |
| 2009/0120544 | A1 * | 5/2009 | Yamaguchi | 148/685 |
| 2009/0297390 | A1 * | 12/2009 | Hidenobu et al. | 420/472 |
| 2011/0002809 | A1 * | 1/2011 | Lo et al. | 420/478 |
| 2011/0056591 | A1 * | 3/2011 | Kondoh et al. | 148/433 |

FOREIGN PATENT DOCUMENTS

| | | | | |
|---|---|---|---|---|
| GB | 1183655 | A | * | 3/1970 |
| JP | 07-116925 | A | | 5/1995 |
| JP | 10-046364 | A | * | 2/1998 |
| JP | 2000-129376 | | | 5/2000 |
| JP | 2000-355746 | | | 12/2000 |
| JP | 2004-332014 | A | | 11/2004 |
| JP | 2006-009053 | A | * | 1/2006 |
| KR | 10-2004-0094593 | | | 11/2004 |

OTHER PUBLICATIONS

International Search Report, PCT Application No. PCT/JP2008/061377, mailed Sep. 14, 2010.

* cited by examiner

COPPER-ZINC ALLOY PRODUCT AND PROCESS FOR PRODUCING COPPER-ZINC ALLOY PRODUCT

This application is a national stage application of PCT/JP2010/061377 which is incorporated herein by reference.

TECHNICAL FIELD

The invention relates to a copper-zinc alloy product which is inexpensive and has excellent resistance to season cracking and to stress corrosion cracking, and a process for producing the copper-zinc alloy product, and particularly, to a copper-zinc alloy product to be a fastener component part such as a fastener element for a slide fastener, a stopper, or the like, and a process for producing the copper-zinc alloy product.

BACKGROUND ART

A copper-zinc alloy is excellent in workability and has been widely used in various fields in the related art. In general, the material costs of the copper-zinc alloy may be reduced by increasing the zinc content because the zinc base metal is cheaper than the copper base metal. Further, when the zinc content is in a range of 43% by weight or less, cold working with a rolling reduction of 80% or more may be performed and strength may be improved by the processing deformation generated in the cold working, and the higher the zinc content is, the more improved effects are obtained.

In addition, the copper-zinc alloy is known to exhibit an inherent alloy color tone depending on the zinc content thereof. For example, a copper-zinc alloy containing zinc in an amount of 15% by weight (generally referred to as red brass) has a reddish gold color tone. Furthermore, a copper-zinc alloy containing zinc in an amount of 30% by weight (generally referred to as seven-three brass) has a yellowish gold color tone, and a copper-zinc alloy containing zinc in an amount of 40% by weight (generally referred to as four-six brass) has a reddish gold color tone as in the red brass.

As for the copper-zinc alloy, in order to further improve properties such as strength, resistance to corrosion, or the like, various research and development activities have been conducted in the related art and put into practical use.

For example, Japanese Patent Application Laid-Open No. 2000-129376 (Patent Document 1) discloses a copper-zinc alloy with the strength improved without deteriorating the workability.

The copper-zinc alloy disclosed in Patent Document 1 contains copper in an amount of 60% by weight or more and less than 65% by weight. Further, the metal structure of the copper-zinc alloy has a two-phase mixed structure composed of fine α-phase and β-phase, except for the coarse β-phase that inevitably remains and the non-recrystallized α-phase. According to Patent Document 1, the strength is not increased in a copper content of 65% by weight or more and the workability is not sufficient in a copper content of less than 60% by weight.

Further, in Patent Document 1, the two-phase mixed structure composed of the fine α-phase and β-phase is said to mean a state in which the β-phase with a size of from 0.1 μm to 2 μm is present while being in contact with the α-phase at the grain boundary. In addition, the β-phase which is inevitably present is said to be a β-phase which is present before a low-temperature annealing or a coarsely growing β-phase which is partially generated from a processed structure during the low-temperature annealing, and the non-recrystallized α-phase is said to mean that a processed structure partially remains while the processed structure is transformed into a two-phase mixed structure during the low-temperature annealing treatment.

When the copper-zinc alloy in Patent Document 1 is produced, an alloy is obtained by first melting a raw material having a predetermined composition, casting the melt, and subjecting the melt to hot working, and then the alloy obtained is subjected to a cold working with a cold working ratio of 50% or more.

After the cold working with a cold working ratio of 50% or more, the alloy is subjected to a low-temperature annealing. Accordingly, the β-phase is created while simultaneously removing the processing deformation. In this case, according to Patent Document 1, it takes time to create the β-phase when the temperature of the low-temperature annealing is low, and the recrystallized α-phase appears when the temperature of the low-temperature annealing is high, thereby making it impossible to obtain a sufficient strength, and thus it is preferred to set the temperature of the low-temperature annealing at approximately from 200° C. to 270° C. According to Patent Document 1, a copper-zinc alloy produced by performing the low-temperature annealing may improve the strength thereof without degrading the workability such as press bendability and the like.

On one hand, for example, Japanese Patent Application Laid-Open No. 2000-355746 (Patent Document 2) discloses a copper-zinc alloy having a zinc content of from 37% by weight to 46% by weight, an α+β crystal structure at normal temperature, a β-phase area ratio of 20% or more in the crystal structure at normal temperature, and an average crystal particle diameter of the α-phase and the β-phase of 15 μm or less, and describes that this type of copper-zinc alloy has excellent cutting performance and strength.

Further, according to Patent Document 2, the copper-zinc alloy is produced by subjecting a copper-zinc alloy material having a zinc content of from 37% by weight to 46% by weight to hot extrusion at a temperature in a range from 480° C. to 650° C. and then cooling the copper-zinc alloy material at 0.4° C./sec or higher until the temperature is 400° C. or less.

PRIOR ART DOCUMENT

Patent Document

Patent Document 1: Japanese Patent Application Laid-Open No. 2000-129376

Patent Document 2: Japanese Patent Application Laid-Open No. 2000-355746

SUMMARY OF THE INVENTION

Problems to be Solved by the Invention

The copper-zinc alloy has been widely used in various fields as described above, and has been frequently used even in, for example, a fastener component part such as a fastener element for a slide fastener, a stopper, and the like. A fastener element or stopper made of a copper-zinc alloy is produced, for example, by slicing a wire rod having a predetermined cross-sectional shape into a predetermined thickness, or punching a plate having a predetermined thickness, and then subjecting each part obtained to press processing and the like to form a coupling head. Moreover, the fastener element or stopper obtained is fixed to a fastener tape for a slide fastener by being clamped to be attached to a marginal portion of the fastener tape.

However, when a fastener element or stopper made of a copper-zinc alloy is fixed to a fastener tape by clamping, the fastener element or stopper is plastically deformed, and thus there is a problem in that season cracking by residual stress occurs or stress corrosion cracking occurs on the fastener element or stopper attached to the fastener tape.

Here, season cracking is a phenomenon that cracks occur on an external surface of a product (fastener element or stopper) when a copper-zinc alloy in which a tensile residual stress is present is exposed to a corrosive environment such as ammonia gas and the like. In addition, stress corrosion cracking is a phenomenon that cracks are generated on the surface of the product due to the interaction of tensile stress and corrosive environment and the cracks progress over time.

It is known that the problem of season cracking or stress corrosion cracking easily occurs in a copper-zinc alloy having a zinc content of more than 15% by weight, and for example, even when a fastener component part is produced by using a copper-zinc alloy having a zinc content of about from 35% by weight to 40% by weight as described in Patent Document 1 or a copper-zinc alloy having a zinc content of from 37% by weight to 46% by weight as described in Patent Document 2, the problem of season cracking or stress corrosion cracking may not be solved.

Furthermore, as a measure for preventing season cracking or stress corrosion cracking, adding a third element and performing an annealing treatment that removes processing deformation have been known in the related art.

For example, as for the addition of a third element, it is known that it is possible to obtain a copper-zinc alloy having excellent resistance to season cracking and to stress corrosion cracking by adding a third element such as tin or the like to the copper-zinc alloy in an amount of several % by weight.

However, all of the third elements whose effect of preventing season cracking or stress corrosion cracking is confirmed are more expensive than zinc, and thus there is a problem in that the increase in material costs occurs. Furthermore, the cold workability of a copper-zinc alloy is reduced by adding a third element such as tin or the like to the copper-zinc alloy, thereby causing adverse effects that make it impossible to perform a cold working under high rolling reduction.

On one hand, when the resistance to season cracking or to stress corrosion cracking of a copper-zinc alloy is improved by subjecting the copper-zinc alloy to annealing treatment, the processing deformation occurring in the copper-zinc alloy disappears due to the annealing treatment. For this reason, there is a problem in that the strength of the copper-zinc alloy is reduced and for example, strength required for a fastener component part may not be sufficiently obtained.

The invention has been made in consideration of the above-described problems in the related art, and a specific object thereof is to provide a copper-zinc alloy product capable of reducing material costs caused by an increase in zinc content, having excellent resistance to season cracking and to stress corrosion cracking and having cold workability and appropriate strength, and a process for producing the copper-zinc alloy product.

Means for Solving the Problems

In order to achieve the above-described object, a copper-zinc alloy product provided by the invention is a copper-zinc alloy product composed of a copper-zinc alloy containing zinc in an amount of higher than 35% by weight and 43% by weight or less and having a two-phase structure composed of an α-phase and a β-phase, as a basic configuration and is most principally characterized in that the ratio of the β-phase in the copper-zinc alloy is controlled to be higher than 100 and less than 40% and the crystal grains of the α-phase and the β-phase are crushed into a flat shape and arranged in a layer shape through cold working.

In the copper-zinc alloy product according to the invention, it is preferred that the crystal grains of the β-phase having a flat shape are formed in a layer shape in a direction intersecting a direction in which cracks caused by season cracking due to residual stress or cracks caused by stress corrosion cracking progress.

Further, in the copper-zinc alloy product according to the invention, it is preferred that the crystal grains of the α-phase and β-phase having a flat shape are arranged along the external surface of the copper-zinc alloy product. In this case, it is preferred that the crystal grains of the β-phase having a flat shape are formed such that a ratio of the length of the long side in a direction parallel to the external surface to the length of the short side in a direction perpendicular to the external surface is 2 or higher, when viewed in the cross section.

In addition, it is preferred that the copper-zinc alloy product of the invention is an intermediate product.

Furthermore, it is preferred that the copper-zinc alloy product of the invention is a fastener component part. In this case, the fastener component part is a fastener element having a coupling head, a body portion extending from the coupling head and installed, and a pair of leg portions divergently extending from the body portion and installed, and it is preferred that the α-phase and β-phase having a flat shape are arranged along an internal side surface of the leg portion that the pair of leg portions face. Further, it is preferred that an internal side surface of a crotch portion connecting from the internal side surface of the leg portion is disposed at the body portion and the α-phase and β-phase having a flat shape are arranged along the internal side surface of the crotch portion of the body portion.

The fastener component part is a stopper which is attached to a fastener tape of a slide faster, and it is preferred that the α-phase and β-phase having a flat shape are arranged along the internal side surface to be in contact with the fastener tape of the stopper.

Next, the process for producing a copper-zinc alloy product provided by the invention is most principally characterized to include a step of controlling a ratio of a β-phase in a copper-zinc alloy containing zinc in an amount of higher than 35% by weight and 43% by weight or less and having a two-phase structure composed of an α-phase and the β-phase to be higher than 10% and less than 40% and a step of subjecting the copper-zinc alloy with the ratio of the β-phase controlled to a cold working with a working ratio of 50% or more.

In the process for producing a copper-zinc alloy product according to the invention, the step of controlling the ratio of the β-phase preferably includes subjecting the copper-zinc alloy to heat treatment.

In addition, it is preferred that the process for producing a zinc-copper alloy product of the invention includes forming the crystal grains of the β-phase having a flat shape in a layer shape in a direction intersecting a direction in which cracks caused by season cracking due to residual stress or cracks caused by stress corrosion cracking progress, through the cold working.

Furthermore, it is preferred that the process for producing a copper-zinc alloy product of the invention includes forming the crystal grains of the β-phase through the cold working such that the ratio of the length of the long side in a direction parallel to the external surface of the copper-zinc alloy product to the length of the short side in a direction perpendicular to the external surface thereof is a predetermined size, when viewed in the cross section. In this case, it is more preferred that the process includes forming the crystal grains of the β-phase such that the ratio of the length of the long side to the length of the short side is 2 or higher, when viewed in the cross section.

In the process for producing a copper-zinc alloy product of the invention, it is preferred that an intermediate product is produced as the copper-zinc alloy product.

Or, it is preferred that a fastener component part is produced as the copper-zinc alloy product by forming a long wire rod or a plate from the copper-zinc alloy and cutting or punching the wire rod or the plate, and it is particularly preferred that a fastener element or stopper is produced as the fastener component part.

Effect of the Invention

The copper-zinc alloy product according to the invention is composed of a copper-zinc alloy containing zinc in an amount of higher than 35% by weight and 43% by weight or less and having a two-phase structure composed of an α-phase (face-centered cubic structure) and a β-phase (body-centered cubic structure). It is possible to securely form a β layer in the copper-zinc alloy to control the ratio of the β layer by increasing the zinc content to a value that is higher than 35% by weight, and to achieve the reduction in material costs by decreasing the copper content in the copper-zinc alloy. On one hand, it is possible to stably form a two-phase structure composed of an α-phase and a β-phase and improve the cold workability of the copper-zinc alloy by controlling the zinc content to be less than 43% by weight.

In addition, in the copper-zinc alloy product of the invention, the ratio of the β-phase is controlled to be higher than 10% and less than 40% and preferably 15% or more and less than 40%. Here, the β-phase in the copper-zinc alloy is a hard structure compared to the α-phase, and the strength of the copper-zinc alloy may be improved by increasing the ratio of the β-phase, but conversely, the cold workability of the copper-zinc alloy is reduced. Furthermore, in the invention, the resistance to season cracking and to stress corrosion cracking of the copper-zinc alloy product may be improved by the presence of the β-phase crushed into a flat shape as described below.

Therefore, when the ratio of the β-phase in the copper-zinc alloy product of the invention is controlled to be 10% or less, the strength of the copper-zinc alloy product is reduced and simultaneously, the effects of improving the resistance to season cracking and to stress corrosion cracking may not be sufficiently obtained. Further, when the rate of the β-phase is controlled to be 40% or higher, the copper-zinc alloy becomes brittle, thereby causing the degradation in cold workability. In addition, the effects of improving the resistance to season cracking and to stress corrosion cracking may not be sufficiently obtained. Therefore, the strength and cold workability of the copper-zinc alloy may be appropriately secured by controlling the ratio of the β-phase in the copper-zinc alloy to a value that is higher than 10% and less than 40%.

In addition, in the copper-zinc alloy product of the invention, the crystal grains of the α-phase and the crystal grains of the β-phase are crushed into a flat shape and arranged in a layer shape by cold working. Furthermore, the layer shape mentioned in the invention means that a plurality of the crystal grains of the β-phase having a flat shape is arranged side by side with directionality and preferably, a plurality of the crystal grains of the β-phase having a flat shape is overlappingly arranged from the external surface through the inside of the product.

Usually, the season cracking or stress corrosion cracking of the copper-zinc alloy product occurs as cracks progress in the crystal grain boundary or the crystal grains of the α-phase. Therefore, since the crystal grains of the α-phase and β-phase crushed into a flat shape are arranged in a layer shape as in the invention, such that, even though cracks occur on the surface of the product, the hard β-phase in a flat shape is present in a layer shape like a wall, it is possible to effectively suppress the cracks generated from progressing and to prevent season cracking or stress corrosion cracking in the copper-zinc alloy product from occurring.

In particular, in the invention, the crystal grains of the β-phase having a flat shape are arranged in a layer shape in a direction intersecting a direction in which cracks caused by season cracking due to residual stress or cracks caused by stress corrosion cracking progress, and thus it is possible to further effectively suppress cracks from progressing.

In the copper-zinc alloy product of the invention, the crystal grains of the α-phase and the β-phase crushed into a flat shape are arranged along the external surface of the product, and thus it is possible to further effectively suppress cracks occurring on the surface of the product from progressing.

Particularly in this case, the crystal grains of the β-phase having a flat shape are formed to have a value of 2 or more and preferably 4 or more as a ratio of the length of the long side in a direction parallel to the external surface to the length of the short side in a direction intersecting the external surface and preferably perpendicular to the external surface, when viewed in the cross section, and thus it is possible to enhance effects of suppressing cracks from progressing and to more stably prevent the occurrence of season cracking or stress corrosion cracking.

Further, the ratio of the length of the long side to the length of the short side mentioned here means an aspect ratio (that is, a value of long side/short side) in the case where the crystal grains of the β-phase are surrounded by a rectangle formed by a short side in a direction perpendicular to the external surface and a long side in a direction parallel to the external surface when the cross section of the copper-zinc alloy product is viewed.

The copper-zinc alloy product according to the invention is appropriately used as an intermediate product such as wire rod or a plate produced before a final product such as, for example, a fastener component part or the like is obtained. Accordingly, the intermediate product according to the invention may be subjected to, for example, a cold working with a working ratio (rolling reduction) of 50% or higher and a working ratio (rolling reduction) of 80% or higher to produce a final product. In addition, in this case, the material costs of the obtained final product may be reduced and resistance to season cracking and to stress corrosion cracking of the final product may be improved.

Furthermore, the copper-zinc alloy product according to the invention is particularly appropriately used as a fastener component part which is generally subjected to a cold working with a working ratio of 50% or higher.

Further, the working ratio mentioned here is a reduction ratio of the cross section, and thus the upper limit is not particularly limited. If the upper limit of the working ratio is to be set, the upper limit is less than 100% and preferably 99% or less because it is impossible to achieve a working ratio of 100%.

For example, when the fastener component part is a fastener element having a coupling head, a body portion extending from the coupling head and mounted, and a pair of leg portions divergently extending from the body portion and mounted, there was a problem in the related art in that season cracking or stress corrosion cracking easily occurs on the internal side surface of the leg portion that the leg portion of the fastener element faces or on the internal side surface of a crotch portion connecting from the internal side surface of the leg portion when the fastener element is processed by being clamping to be attached to a fastener tape.

However, when the copper-zinc alloy product according to the invention is a fastener element and the α-phase and the β-phase having a flat shape are arranged along the internal side surface of the leg portion of the fastener element, it is possible to effectively prevent season cracking or stress corrosion cracking from occurring on the internal side surface of the leg portion even though the fastener element is processed by being clamped to be mounted on the fastener tape. In addition, when the α-phase and the β-phase having a flat shape are arranged along the internal side surface of the crotch portion of the body portion, it is also possible to effectively prevent season cracking or stress corrosion cracking from occurring on the internal side surface of the crotch portion.

Furthermore, when the fastener component part is a stopper to be attached to the fastener tape of the slide fastener, if the α-phase and the β-phase having a flat shape are arranged along the internal side surface of the stopper in contact with the fastener tape, it is possible to effectively prevent season cracking or stress corrosion cracking from occurring on the internal side surface of the stopper even though the stopper is processed by being clamped and is mounted on the fastener tape.

Next, the process for producing a copper-zinc alloy product according to the invention includes a step of controlling the ratio of the β-phase in a copper-zinc alloy containing zinc in an amount of higher than 35% by weight and 43% by weight or less and having a two-phase structure composed of the α-phase and the β-phase to a value that is higher than 10% and less than 40% and preferably 15% or higher and less than 40% and a step of subjecting the copper-zinc alloy with the ratio of the β-phase controlled to a cold working with a working ratio of 50% or higher.

According to the production process of the invention, by using a copper-zinc alloy containing zinc in an amount of higher than 35% by weight and 43% by weight or less, it is possible to readily reduce the material costs of the copper-zinc alloy product. Further, it is possible to appropriately secure the strength and cold workability of the copper-zinc alloy by controlling the ratio of the β-phase in the copper-zinc alloy to a value that is higher than 10% and less than 40%.

In addition, the crystal grains of the α-phase and the crystal grains of the β-phase which are present in the copper-zinc alloy may be crushed into a flat shape and arranged in a layer shape by subjecting the copper-zinc alloy with the ratio of the β-phase controlled to a cold working with a working ratio of 50% or higher, and thus it is possible to produce a copper-zinc alloy product having excellent resistance to season cracking and to stress corrosion cracking.

In this process for producing a copper-zinc alloy product of the invention, it is possible to stably control the ratio of the β-phase in the copper-zinc alloy to a value that is higher than 10% and less than 40% by subjecting the copper-zinc alloy to heat treatment in a step of controlling the ratio of the β-phase in the copper-zinc alloy.

Furthermore, in the process for producing a copper-zinc alloy product of the invention, it is possible to stably produce a copper-zinc alloy product having fairly excellent resistance to season cracking and to stress corrosion cracking by forming the crystal grains of the β-phase having a flat shape in a layer shape in a direction intersecting a direction in which cracks caused by season cracking due to residual stress or cracks caused by stress corrosion cracking progress, through the cold working.

Further, in the process for producing a copper-zinc alloy product of the invention, the crystal grains of the β-phase are formed through the cold working such that the ratio of the length of the long side in a direction parallel to the external surface of the product to the length of the short side in a direction perpendicular to the external surface of the product is a predetermined size, preferably 2 or more and more preferably 4 or more, when viewed in the cross section. Accordingly, it is possible to further enhance the resistance to season cracking and to stress corrosion cracking of the copper-zinc alloy product produced.

According to this process for producing a copper-zinc alloy product of the invention, an intermediate product may be produced as the copper-zinc alloy product. The intermediate product produced by the invention may be subjected to, for example, a cold working with a working ratio of 50% or higher, and a final product obtained from the intermediate product is inexpensive due to the reduction in material costs and has excellent resistance to season cracking and to stress corrosion cracking.

In addition, according to the process for producing a copper-zinc alloy product of the invention, a fastener component part such as a fastener element or a stopper may be appropriately produced as a copper-zinc alloy product by forming a long wire rod or a plate from the copper-zinc alloy and cutting or punching the wire rod or the plate. Accordingly, even though the fastener component part produced is subjected to cold working such as clamping processing and the like, season cracking or stress corrosion cracking may be effectively prevented from occurring.

MODE FOR CARRYING OUT THE INVENTION

Hereinafter, appropriate embodiments of the invention will be described in detail with reference to the accompanying drawings. Further, the invention is not limited to embodiments which will be described hereinbelow, but various modifications are possible as long as the modifications have substantially the same configuration as the invention and may provide the same operational effects.

For example, although the case of producing a fastener component part as a copper-zinc alloy product will be described in the following embodiments, the invention may be applied similarly even to a copper-zinc alloy product other than the fastener component part, or an intermediate product (for example, a long wire rod and the like as described below) before a final product is obtained.

The fastener component part according to the embodiment is a part made of a copper-zinc alloy, which constitutes a slide fastener, and examples thereof include a faster element, an upper stopper, a lower stopper, a separable bottom end stop, a slider, and the like.

Figure 1:
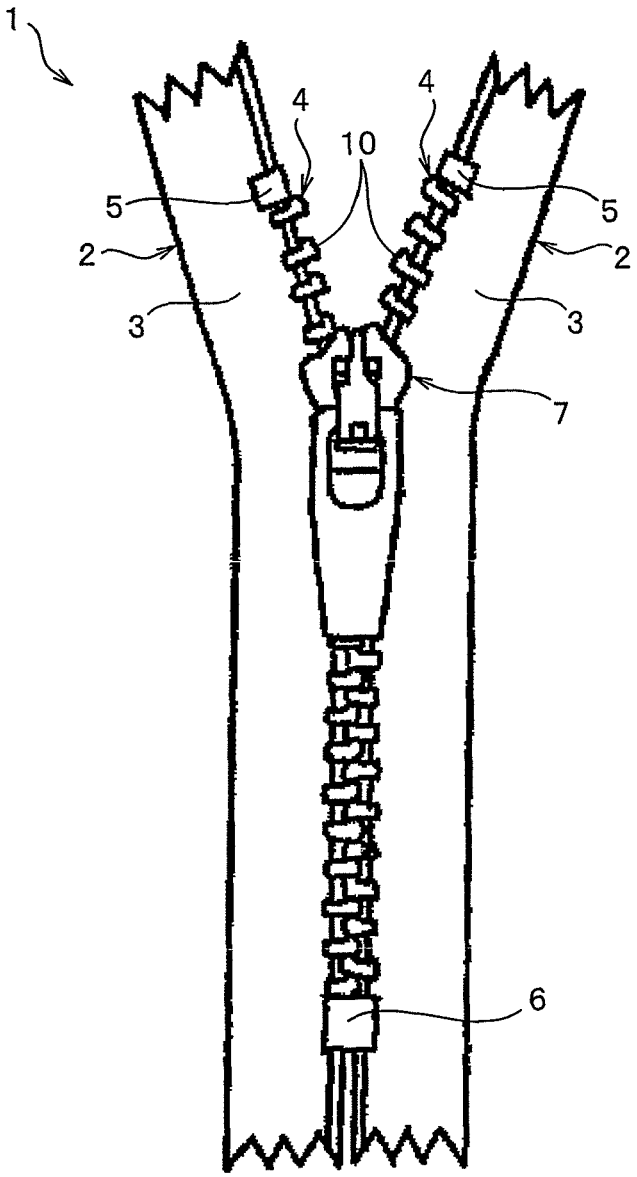
FIG. 1 is a front view of a slide fastener.

Here, for example, as described in FIG. 1, a slide fastener 1 has a pair of left and right fastener stringers 2 at which a plurality of fastener elements 10 is mounted in line at a tape marginal portion that a fastener tape 3 faces to form an element row 4, an upper stopper 5 and a lower stopper 6, which are attached along the element row 4 at the upper end portion and the lower end portion of the left and right fastener stringers 2, and a slider 7 slidably disposed along the element row 4.

Figure 2:
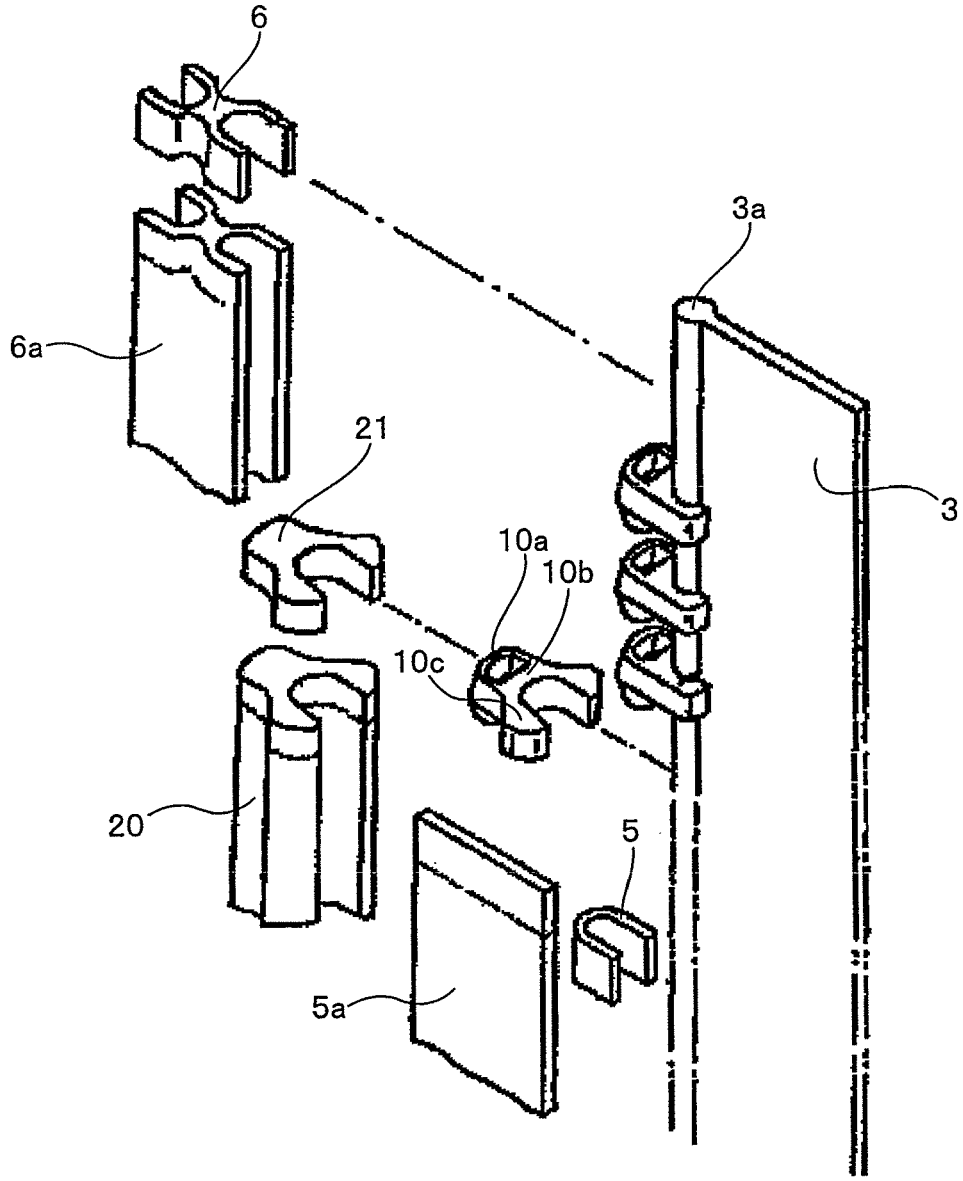
FIG. 2 is a descriptive view describing mounting of a fastener element and upper and lower stoppers into a fastener tape.

In this case, as described in FIG. 2, each fastener element 10 is produced by slicing a wire rod 20 having an approximately Y-shaped cross-section called a Y bar into a predetermined thickness and subjecting an element material 21 which is sliced to press working and the like to form a coupling head 10*a*.

At this time, the fastener element 10 obtained has the coupling head 10*a* formed by press working and the like, a body portion 10*b* extending from the coupling head 10*a* in one direction and mounted, and a pair of leg portions 10*c* divergently extending from the body portion 10*b* and mounted at two crotch portions. Moreover, the fastener element 10 is attached to the fastener tape 3 at a predetermined interval, by plastically deforming both leg portions 10*c* while being fixed by being clamped in a direction (internal side) of approaching each other in a state that an element attaching portion including a core thread portion 3*a* of the fastener tape 3 is inserted between the pair of leg portions 10*c*.

The upper stopper 5 for the slide fastener 1 is produced by slicing a flat square material 5*a* having a square cross section into a predetermined thickness and subjecting a fragment obtained to bending working to mold the fragment into an approximately U-shaped cross-section. In addition, the upper stopper 5 is attached to each of the left and right fastener tapes 3 by plastically deforming the upper stopper 5 while being clamped in a state that the element attaching portion of the fastener tape 3 is inserted into the space portion on the inner peripheral side thereof.

The lower stopper 6 for the slide fastener 1 is produced by slicing a heteromorphic wire rod 6*a* having an approximately H-shaped cross-section (or approximately X-shaped) into a predetermined thickness. Furthermore, the lower stopper 6 is attached throughout the left and right fastener tapes 3 by plastically deforming the lower stopper 6 while being clamped in a state that the element attaching portions of the left and right fastener tapes 3 are inserted into the space portion on the left and right inner peripheral sides thereof, respectively.

In this slide fastener 1, the fastener component part according to the embodiment is particularly appropriately applied as the fastener element 10 or the upper and lower stoppers 5 and 6, which are subjected to working by being clamped when attached to the fastener tape 3, as described above. In addition, hereinafter, the fastener element 10 made of a copper-zinc alloy to which the invention is appropriately applied will be mainly described.

The fastener element 10 according to the invention is made of a copper-zinc alloy composed of copper, zinc and inevitable impurities. Here, the inevitable impurities mean impurities which are present in the raw material or inevitably incorporated in the production step and a trace amount of impurities which are accepted to a degree that characteristics of the copper-zinc alloy product may not be affected.

In the copper-zinc alloy used as a material for the fastener element 10, the zinc content in the alloy is adjusted to a value that is higher than 35% by weight and 43% by weight or less and the copper-zinc alloy has a two-phase structure of an u-phase of face-centered cubic lattice and a β-phase of body-centered cubic lattice.

Here, when the zinc content in the copper-zinc alloy is 35% by weight or less, the β-phase in the alloy is not formed or it is difficult to control the ratio of the β-phase to the following range even though the β-phase in the alloy is formed. Further, when the zinc content in the copper-zinc alloy is small, the content of copper included in the copper-zinc alloy is essentially increased, and thus the material costs of the fastener element 10 are increased as the content of copper is increased. On one hand, when the zinc content in the copper-zinc alloy exceeds 43% by weight, the single-phase structure of the β-phase of the copper-zinc alloy becomes brittle, and thus the cold workability of the copper-zinc alloy deteriorates and brittle fracture easily occurs.

In addition, the fastener element 10 may show a color tone (that is, a color tone of reddish gold color) which is the same as the color tone of the fastener element 10 in the related art, which is composed of a copper-zinc alloy having a zinc content of approximately 15% by weight, by controlling the zinc content of the copper-zinc alloy to the above-described range. Specifically, the color tone of the copper-zinc alloy has an L value of from 60 to 90, an a value of from 0 to 5, and a b value of from 15 to 35 in the Lab color system. Accordingly, even though the slide fastener 1 is configured by using the fastener element 10 of the embodiment, the slide fastener 1 includes the same color as in the related art and thus never gives discomfort to a user of the slide fastener 1.

Furthermore, in a copper-zinc alloy used in the fastener element 10, the ratio of the β-phase is controlled to a value that is higher than 10% and less than 40% and preferably 15% or higher and less than 40%. Here, when the ratio of the β-phase is 10% or less, it is not possible to sufficiently obtain effects of improving resistance to season cracking and to stress corrosion cracking as described below. On one hand, when the ratio of the β-phase is controlled to a value that is 40% or higher, the copper-zinc alloy becomes brittle and cold workability of the copper-zinc alloy deteriorates.

Furthermore, in the fastener element 10 according to the embodiment, the crystal grains of the α-phase and the crystal grains of the β-phase in at least a part of the crystal structure of the copper-zinc alloy are crushed into a flat shape and arranged in a layer shape. In this case, as schematically illustrated in FIG. 3 for easily understanding the arrangement of the β-phase crushed into a flat shape in the fastener element, crystal grains 15 of the β-phase having a flat shape, which are schematically shown with thin lines, are arranged in a layer shape along the external surface thereof at least in a region in the vicinity of an external surface constituting the outer peripheral surface in the Y bar before the fastener element 10 is sliced.

Figure 3:
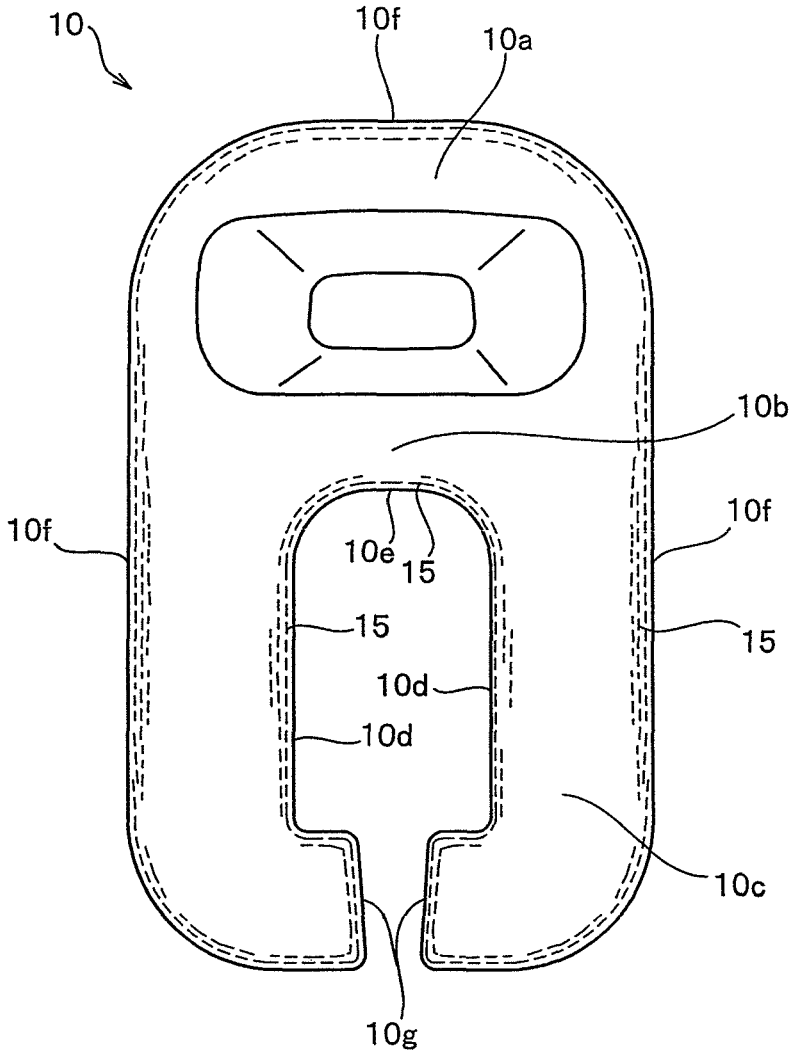
FIG. 3 is a schematic view schematically illustrating a position at which the crystal grains of the β-phase having a flat shape are arranged.
Figure 12:
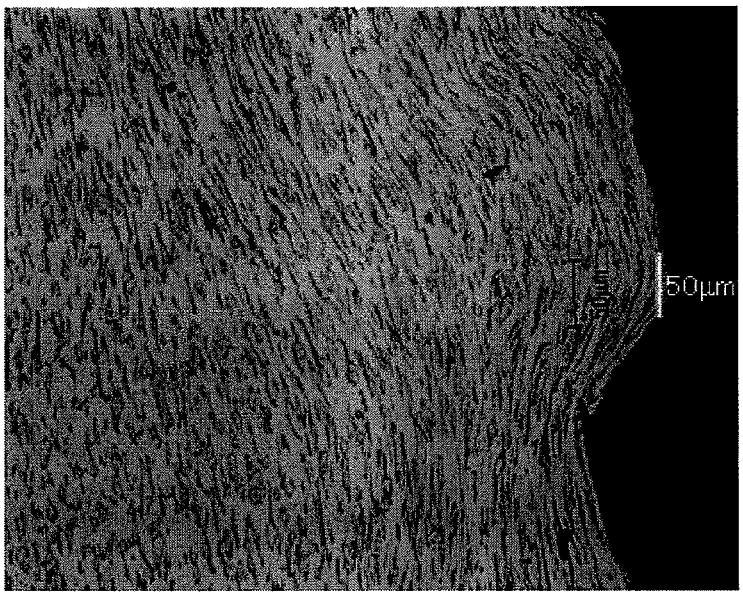
FIG. 12 is a copy of an optical microscope photo obtained by observing a structure in the vicinity of the internal side surface of a leg portion of a fastener element according to Example 1.
Figure 13:
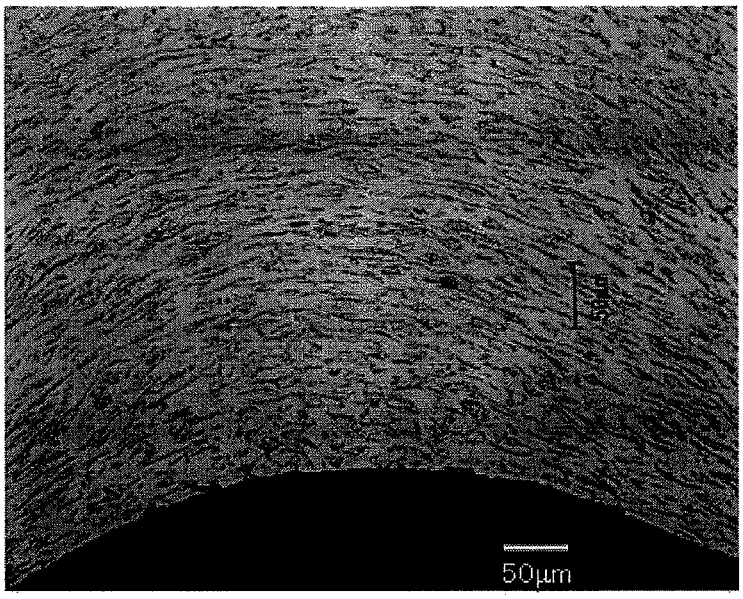
FIG. 13 is a copy of an optical microscope photo obtained by observing a structure in the vicinity of the internal side surface of a crotch portion of a fastener element according to Example 1.

Further, in FIG. 3, for better understanding of the crystal grains 15 of the β-phase having a flat shape, the grain crystals are displayed in a size larger than the actual size, but the actual crystal grains of the β-phase are formed in a size smaller than the size shown in FIG. 3 (see, for example, FIGS. 12 and 13). In addition, the external surface mentioned here is a surface exposed to the outer side, and an internal side surface 10*d* of the leg portion disposed to face the internal side of the leg portion 10*c* or the inner peripheral surface in a coupling recessed portion formed at the coupling head 10*a* is included in the external surface mentioned here. Furthermore, the crystal grains of the α-phase having a flat shape, which are formed at the fastener element 10, are also arranged in a region approximately the same as the region in which the crystal gains of the β-phase having a flat shape are arranged.

Particularly in the case of the fastener element 10 of the embodiment, the crystal grains of the β-phase having a flat shape are characterized to be formed at least in the vicinity (top layer portion) of the internal side surface 10*d* of the leg portion that the leg portion 10*c* faces, and it is preferred that the crystal grains of the β-phase are arranged even in the vicinity (top layer portion) of an internal side surface 10*e* of the crotch portion of the body portion 10*b* formed to be connected from the internal side surface 10*d* of the leg portion.

That is, since the fastener element 10 in the related art is fixed by being clamped at normal temperature when generally attached to the fastener tape 3, tensile residual stress resulting from the plastic deformation of the leg portion 10*c* occurs in the vicinity of the internal side surface 10*d* of the leg portion or the internal side surface 10*e* of the crotch portion in the fastener element 10 after being attached, and thus season cracking easily occurred at the internal side surface 10*d* of the leg portion or the internal side surface 10*e* of the crotch portion.

Further, for example, when the fastener element 10 attached to the fastener tape 3 is pulled, tensile stress is easily applied to the internal side surface 10*d* of the leg portion or the internal side surface 10*e* of the crotch portion, which is directly engaged to the fastener tape 3, and thus stress corrosion cracking easily occurred at the internal side surface 10*d* of the leg portion or the internal side surface 10*e* of the crotch portion.

On the contrary, in the fastener element 10 of the embodiment, the crystal grains of the hard β-phase having a flat shape are arranged in a layer shape at least in a region (top surface portion) in the vicinity of the internal side surface 10*d* of the leg portion or the internal side surface 10*e* of the crotch portion, at which season cracking or stress corrosion cracking easily occurred in the related art. Accordingly, even though cracks resulting from residual stress and the like occur from the internal side surface 10*d* of the leg portion or the internal side surface 10*e* of the crotch portion, a plurality of the β-phases having a flat shape formed in a layer shape are arranged longitudinally in a direction intersecting a direction in which cracks caused by season cracking or stress corrosion cracking progress and preferably in a direction perpendicular thereto, and thus cracks may be dispersed or cracks may be blocked from progressing. For this reason, cracks may be prevented from becoming large (deepening), and season cracking or stress corrosion cracking, which impairs the quality of the fastener element 10, may be prevented from occurring.

Particularly in the embodiment, when the crystal structure in the cross section of the leg portion 10*c* or the body portion 10*b* of the fastener element 10 is viewed, the crystal grains of the β-phase having a flat shape are arranged along the external surface (internal side surface 10*d* of the leg portion or the internal side surface 10*e* of the crotch portion) of the fastener element 10 and formed such that a ratio of the length of the short side in a direction perpendicular to the external surface thereof and the length of the long side in a direction parallel to the external surface thereof, that is, an aspect ratio (value of long side/short side) of a square formed by a short side in a direction perpendicular to the external surface and a long side in a direction parallel to the external surface becomes 2 or more and preferably 4 or more.

In addition, the direction perpendicular to the external surface indicates a depth direction of the alloy based on the external surface of the fastener element 10 when the crystal structure of the fastener element 10 is viewed in the cross section, and for example, when the external surface thereof is a curved surface, the direction means a direction approximately perpendicular to the tangential direction of the curved surface. On one hand, the direction parallel to the external surface indicates a direction along the external surface of the fastener element 10 when the crystal structure of the fastener element 10 is viewed in the cross section, and for example, when the external surface thereof is a curved surface, the direction means a direction approximately parallel to the tangential direction of the curved surface. Furthermore, the direction perpendicular to the external surface and the direction parallel to the external surface do not always need to be perpendicular to each other and the angle of intersection may be displaced to a degree that the angle includes an error from 90°.

Figure 4:
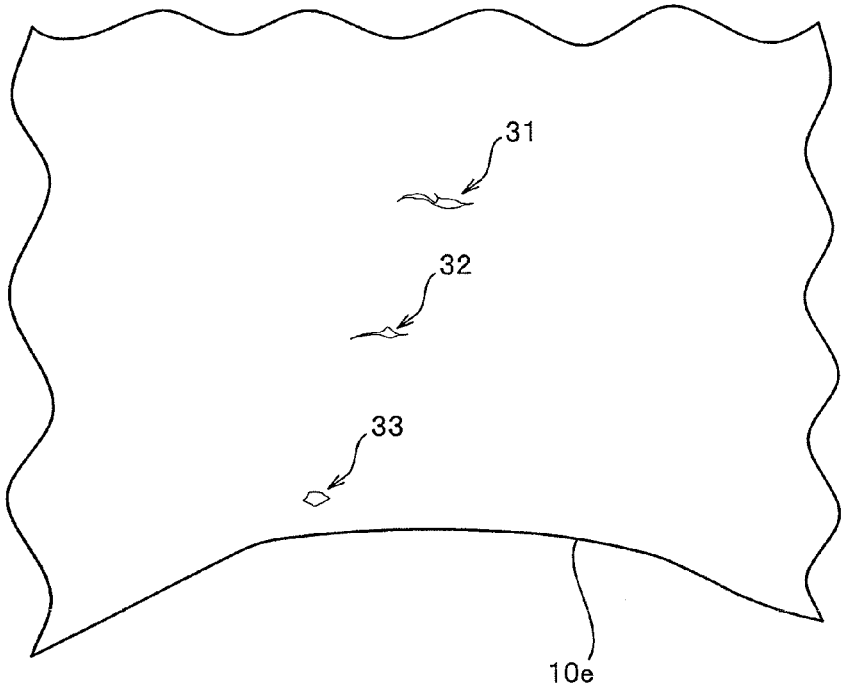
FIG. 4 is a schematic view schematically illustrating the crystal grains of the β-phase formed on the top layer portion on the internal side surface of a crotch portion of the fastener element.

Here, the ratio of the length of the short side in a direction perpendicular to the external surface and the length of the long side in a direction parallel to the external surface will be described in more detail with reference to FIGS. 4 to 7. FIG. 4 is a view schematically illustrating three crystal grains which are arbitrarily selected from the crystal grains of the β-phase formed on the top surface portion of the internal side surface 10*e* of the crotch portion of the fastener element 10 in FIG. 13 to be described below and FIG. 6 is a view schematically illustrating three crystal grains which are arbitrarily selected from the crystal grains of the β-phase formed on the top surface portion of the internal side surface 10*d* of the leg portion of the fastener element 10 in FIG. 12 to be described below.

Figure 5:
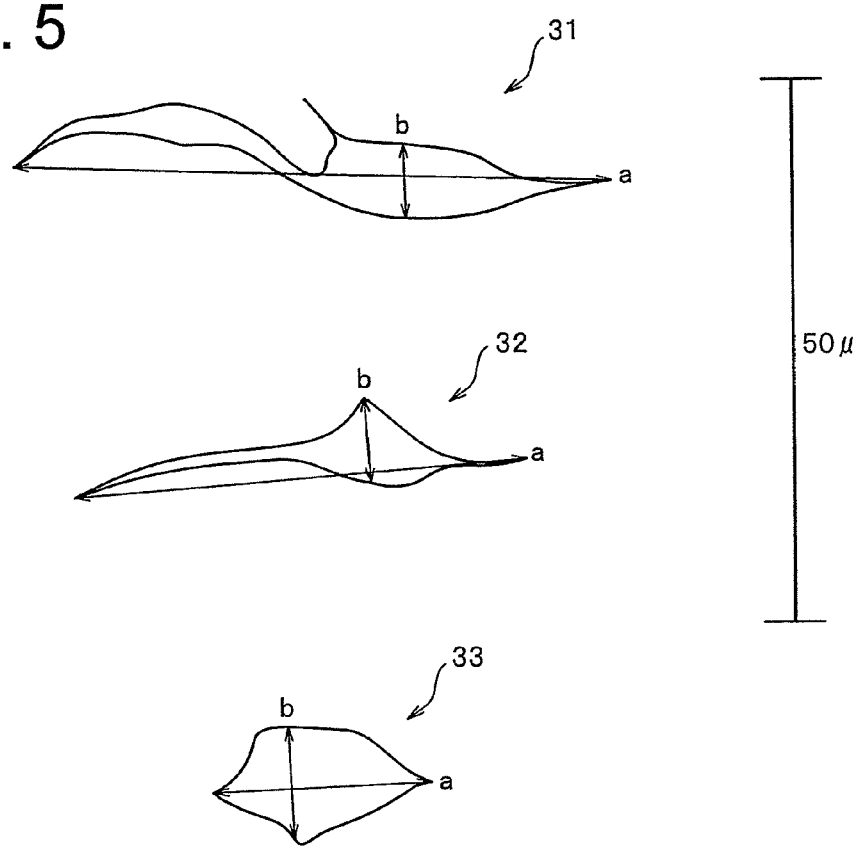
FIG. 5 is a descriptive view describing the length of the long side and the length of the short side in each crystal grain of the β-phase.
Figure 6:
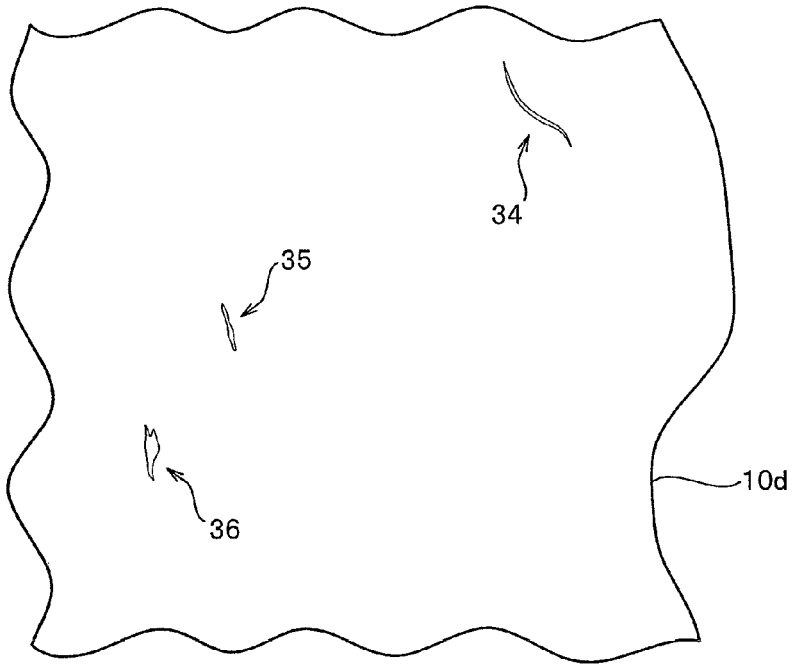
FIG. 6 is a schematic view schematically illustrating the crystal grains of the β-phase formed on the top layer portion on the internal side surface of a leg portion of the fastener element.
Figure 7:
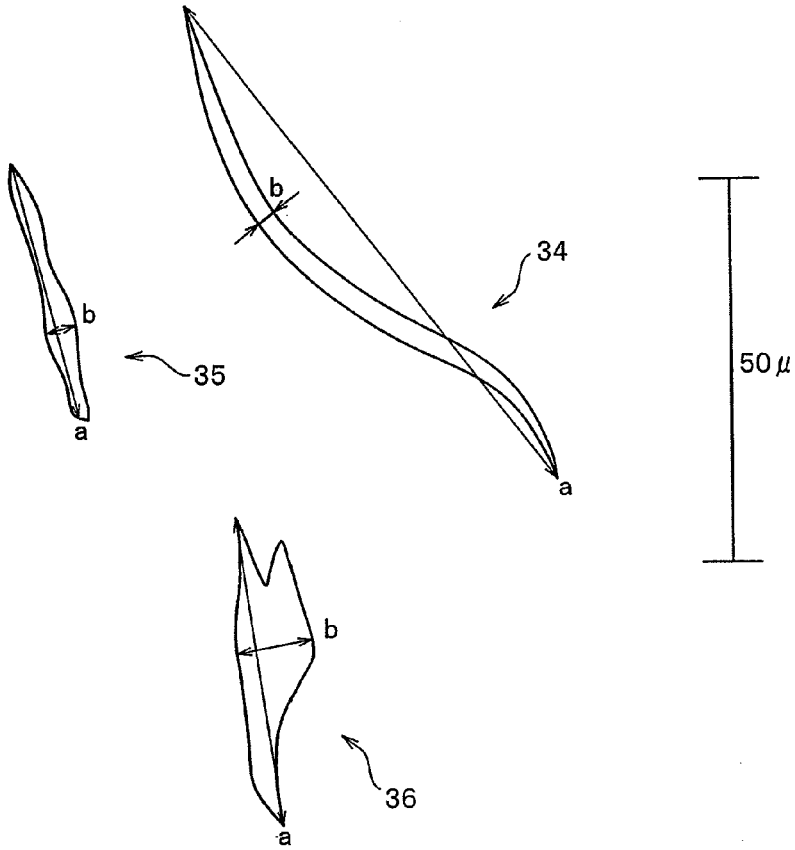
FIG. 7 is a descriptive view describing the length of the long side and the length of the short side in each crystal grain of the β-phase.

Crystal grains 31, 32, and 33 of the β-phase illustrated in FIG. 4, which are formed on the top surface portion of the internal side surface 10*e* of the crotch portion of the fastener element 10, and crystal grains 34, 35, and 36 of the β-phase illustrated in FIG. 6, which are formed on the top surface portion of the internal side surface 10*d* of the leg portion are arranged along the external surface of the fastener element 10, and the length a of the long side in a direction parallel to the external surface of the fastener element 10 and the length b of the short side in a direction perpendicular to the external surface thereof may be defined as illustrated in FIGS. 5 and 7, respectively.

That is, when the crystal grain 31 of the β-phase is viewed, the size of the line segment connecting between one end portion and the other end portion of the longitudinal direction (a direction parallel to the external surface) of the crystal grain 31 is defined as the length a of the long side. Further, when the size between the crystal grain boundaries in a direction (a depth direction for the external surface) perpendicular to the external surface for the crystal grain 31 is measured, the size of a part at which the size between the crystal grain boundaries is the greatest is defined as the length b of the short side.

When the length a of the long side and the length b of the short side are defined as described above, the value of "length a of the long side/length b of the short side" becomes an aspect ratio of the crystal grain 31. In addition, even for the crystal grains 32 to 36 of the β-phase, the length a of the long side and the length b of the short side are defined similarly to the crystal grain 31 of the β-phase, as illustrated in FIGS. 5 and 7. Furthermore, as illustrated in FIGS. 5 and 7, each of the crystal grains 31 to 36 of the β-phase has different directions along the internal side surface 10*e* of the crotch portion and the internal side surface 10*d* of the leg portion depending on the position at which the crystal grains are arranged, and thus the directions of the length a of the long side and the length b of the short side are also different for each of the crystal grains 31 to 36.

Further, in the invention, the direction of the cross section of the fastener element 10 may be arbitrarily set when the crystal structure is viewed. In this case, the direction perpendicular to the external surface is set in one direction irrespective of the direction of the cross section direction thereof, but the direction parallel to the external surface varies depending on the direction of the cross section direction thereof.

Figure 8:
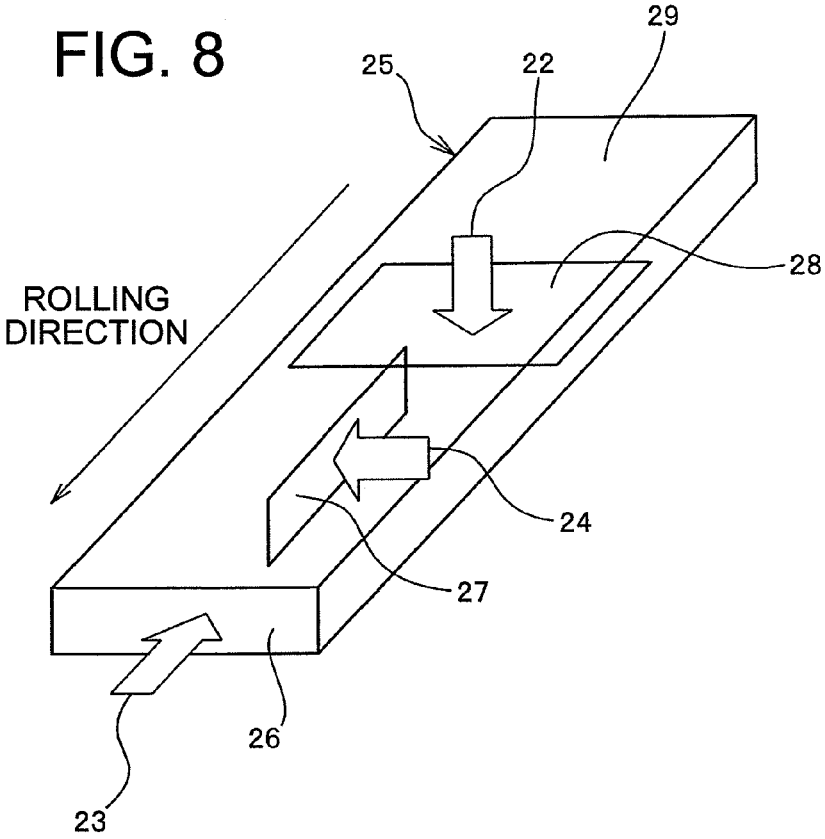
FIG. 8 is a descriptive view conceptually describing a direction perpendicular to the external surface, a direction parallel to the external surface, and a direction of each cutting plane, with respect to a rolling direction.

For example, as in a copper-zinc alloy foil 25 conceptually illustrated in FIG. 8, the direction perpendicular to the external surface in the fastener element 10 is a direction 22 perpendicular to a rolling surface 29 to be rolled in cold working, and the perpendicular direction is basically determined in one direction which is a depth direction for one rolling surface 29. On one hand, the direction parallel to the external surface is a direction parallel to the rolling surface 29, and examples of the direction in the rolling surface 29 include a direction 23 parallel to the rolling direction, a direction 24 perpendicular to the rolling direction, a direction inclined to the rolling direction, and the like.

For this reason, in the embodiment, when the fastener element 10 is cut at any surface perpendicular to the rolling surface 29, the crystal grains of the β-phase are formed to have a value of 2 or more as a ratio of the length of the short side and the length of the long side in a cutting plane 26 thereof (or cutting plane 27). Particularly in the embodiment, it is preferred that the ratio of the length of the short side and the length of the long side is formed to have a value of 2 or more on both a cutting plane 26 (or cutting plane 27) and a cutting plane 27 (or cutting plane 26) perpendicular to the cutting plane 26 (or the cutting plane 27).

That is, when the fastener element 10 is cut, for example, in a direction perpendicular to the rolling surface to be rolled in cold working and parallel to the rolling direction, the ratio of the length of the short side and the length of the long side in the crystal grains of the β-phase is formed to have a value of 2 or higher in a cutting plane parallel to the rolling direction, and even when the fastener element 10 is cut in a direction perpendicular to the rolling surface and perpendicular to the rolling direction, it is preferred that the ratio of the length of the short side and the length of the long side in the crystal grains of the β-phase is formed to have a value of 2 or higher in a cutting plane perpendicular to the rolling direction.

As described above, if the ratio of the length of the short side and the length of the long side in the crystal grains of the β-phase having a flat shape has a relationship of 2 or higher and preferably 4 or higher in one cutting plane and preferably two or more cutting planes, cracks may be effectively blocked from deeply progressing from the internal side surface 10*d* of the leg portion or the internal side surface 10*e* of the crotch portion of the fastener element 10 and resistance to season cracking and to stress corrosion cracking of the fastener element 10 may be improved, by arranging the crystal grains of the β-phase in a layer shape.

Therefore, for example, the fastener element 10 of the embodiment is produced by performing a cold working with a working ratio of, for example, 80% or higher, and thus even when residual stress occurs in the fastener element 10, season cracking or stress corrosion cracking may be stably prevented from occurring on the fastener element 10.

In addition, in the fastener element 10 of the embodiment, the crystal grains of the β-phase having a flat shape are arranged in a layer shape not only on the internal side surface 10*d* of the leg portion or the internal side surface 10*e* of the crotch portion but also on the coupling head 10*a*, the body portion 10*b*, each external side surface 10*f* of the leg portion 10*c*, or an end surface 10*g* disposed to face the end of both the leg portions 10*c*, as illustrated in FIG. 3. Therefore, in the fastener element 10, season cracking or stress corrosion cracking may be effectively prevented from occurring not only on the internal side surface 10*d* of the leg portion or the internal side surface 10*e* of the crotch portion, on which residual stress easily occurs, but also on the coupling head 10*a*, the body portion 10*b*, and each external side surface of the leg portion 10*c*, or the end surface of both the leg portions 10*c*.

Furthermore, in the fastener element 10 of the embodiment, a region in which the crystal grains of the α-phase having a flat shape or the crystal grains of the β-phase having a flat shape are arranged is not limited to a region (top surface portion) in the vicinity of the external surface of the fastener element 10, and the crystal grains of the α-phase having a flat shape or the crystal grains of the β-phase having a flat shape may be arranged in a depth region from the external surface of the fastener element 10.

Next, a process for producing the fastener element 10 according to the embodiment as described above will be described.

First, a billet of a copper-zinc alloy having a predetermined cross-sectional surface area is cast. At this time, the billet is cast such that the zinc content in the composition of the copper-zinc alloy is adjusted to a value that is higher than 35% by weight and 43% by weight or less. At this time, the cast billet has a two-phase structure of the α-phase and the β-phase.

Subsequently, by subjecting the obtained billet to heat treatment, the ratio of the α-phase and the β-phase in the copper-zinc alloy is controlled to have a value that is higher than 10% and less than 40% and preferably 15% or higher and less than 40% as a ratio of the β-phase. In this case, the conditions of heat treatment performed on the billet may be arbitrarily set according to the composition of the copper-zinc alloy. Further, for example, when the billet is cast and the ratio of the β-phase in the copper-zinc alloy may be controlled to the above-described range, performing the heat treatment as described above may be omitted.

A long wire rod which is an intermediate product is manufactured by controlling the ratio of the β-phase in the billet and then subjecting the billet to cold working such as cold extrusion working and the like, for example, such that the working ratio is 50% or higher. In addition, in the invention, the cold working may be performed at a temperature that is less than the recrystallization temperature of a copper-zinc alloy, a temperature of preferably 200° C. or less and a temperature of particularly 100° C. or less.

In the long wire rod obtained by subjecting the billet of a copper-zinc alloy to cold working as described above, the crystal grains of the α-phase and the crystal grains of the 13-phase in the copper-zinc alloy are crushed into a flat shape and arranged in a layer shape. Particularly in this case, the crystal grains of the α-phase and the crystal grains of the β-phase have a flat shape elongating along the working direction (rolling direction) by performing the cold working.

Thereafter, a Y bar 20 as described above is molded by performing a cold working on the long wire rod subjected to cold working through a plurality of rolling mill rolls such that the transverse cross-section of the wire rod has approximately a Y shape. Accordingly, the crystal grains of the β-phase having a flat shape may be densely arranged, for example, along the internal side surface 10*d* of the leg portion or the internal side surface 10*e* of the crotch portion of the fastener element 10 by crushing the crystal grains of the α-phase and the crystal grains of the β-phase in the copper-zinc alloy into a flat shape. In this case, when the longitudinal cross section of the long Y bar 20 obtained is viewed, the crystal grains of the β-phase having a flat shape arranged along the peripheral surface of the Y bar 20 are formed to have a value of 2 or higher as the ratio of the length of the long side to the length of the short side.

Moreover, the fastener element 10 may be stably produced by slicing the above Y bar 20 into a predetermined thickness and subjecting the sliced element material 21 to press working and the like by a forming punch or a forming die using an apparatus as described in, for example, Japanese Patent Application Laid-Open No. 2006-247026 to form the coupling head 10*a*.

Here, when a cold working having a Y shape is performed at a working ratio of 50% or higher in the step of producing the Y bar 20, the billet is subjected to wire drawing and then may be subjected to heat treatment in order to control the ratio of the β-phase. Furthermore, the intermediate product at this time is a Y bar.

Further, the fastener element 10 is mainly described in the above-described embodiments, but the invention may be applied similarly even to the upper stopper 5, the lower stopper 6, a separable bottom end stop, and the slider 7, as described above.

For example, in the case of the upper stopper 5, a billet made of a copper-zinc alloy having the same composition as the fastener element 10 is first cast, and the billet is subjected to heat treatment to control the ratio of the β-phase in the copper-zinc alloy. Next, a flat square material 5*a* (intermediate product) having a tetragonal cross section is manufactured by subjecting the billet obtained to cold working. Thereafter, the obtained flat square material 5*a* is sliced into a predetermined thickness as illustrated in FIG. 2, and an upper stopper 5 may be produced by subjecting the fragment obtained to bending working to perform molding into a shape having an approximately U-shaped cross section.

On one hand, in the case of the lower stopper 6, a billet made of a copper-zinc alloy having the same composition as the fastener element 10 or the upper stopper 5 is first cast, and the billet is subjected to heat treatment to control the ratio of the β-phase in the copper-zinc alloy. Next, a heteromorphic wire rod 6*a* (intermediate product) having an approximately H-shape cross section (or approximately an X-shaped) is manufactured by subjecting the obtained billet to cold working. Thereafter, the lower stopper 6 may be produced by slicing the obtained heteromorphic wire rod 6*a* into a predetermined thickness as illustrated in FIG. 2.

In the upper stopper 5 or lower stopper 6 obtained as described above, it is possible to stably prevent season cracking or stress corrosion cracking from occurring on the upper and lower stoppers 5 and 6 similarly to the fastener element 10 because the crystal grains of the β-phase having a flat shape, which have a value of 2 or higher as a ratio of length of the long side to the length of the short side, are compactly arranged along the internal side surface thereof which is brought into contact with the fastener tape 3 when attached to the fastener tape 3.

EXAMPLES

Hereinafter, the invention will be described in more detail by Examples and Comparative Examples, but the invention is not limited thereto.

First, test specimens for Examples 1 to 4 and Comparative Examples 1 to 5 were manufactured according to the conditions described in detail hereinbelow, and each test specimen obtained was subjected to evaluations related to resistance to season cracking, resistance to stress corrosion cracking, cold workability, and strength.

First, copper and zinc weighed were dissolved under argon atmosphere in a predetermined composition shown in the following Tables 1 and 2 by a high frequency vacuum dissolution apparatus to manufacture an ingot having a diameter of 40 mm, an extruded material having a diameter of 8 mm was manufactured from the obtained ingot having a diameter of 40 mm, and the extruded material obtained was subjected to cold working until a predetermined plate shape having a plate thickness in a range from 1.1 mm to 5.0 mm was obtained.

Next, the extruded material was subjected to heat treatment in a range from 400° C. to 700° C. such that the ratio of the β-phase in the copper-zinc alloy was a predetermined value shown in the following Tables 1 and 2. Subsequently, a plate-shaped extruded material, which had been subjected to heat treatment to remove the processing deformation, was subjected to cold rolling of performing a roll working with a predetermined working ratio shown in Tables 1 and 2 only in an upward and downward direction to produce a long plate. Thereafter, a test specimen with a size of thickness (size in an upward and downward direction) 1 mm×width (size in a lateral direction) 5 mm×length (size in a rolling direction) was cut off from the obtained plate.

Further, for each test specimen obtained, the structure of the copper-zinc alloy in a region in the vicinity of the upper surface was observed with the cross-sectional photo thereof. At this time, as illustrated in FIG. 8, for a test specimen 25, the structure of the copper-zinc alloy was observed in the cutting plane 26 perpendicular to the rolling surface 29 and perpendicular to the rolling direction, the cutting plane 27 perpendicular to the rolling surface 29 and parallel to the rolling direction, and the cutting plane 28 parallel to the rolling surface 29. In addition, the length of the short side and the length of the long side of the crystal grains of the β-phase observed in the cutting plane 27 were measured and the ratio of the length of the long side to the length of the short side (value of the length of the long side/the length of the short side) was obtained.

Furthermore, for each test specimen in Examples and Comparative Examples, evaluations of resistance to season cracking, resistance to stress corrosion cracking, cold workability, and strength were performed as follows.

For the evaluation of resistance to season cracking, the evaluation was performed with an accelerated test method based on JBMA-T301 (Japan Brass Makers Association Standard), and a test specimen having a length of 150 μm or less in season cracking occurring after exposure to ammonia was evaluated as "○" and a test specimen having a length of higher than 150 μm was evaluated as "x".

For the evaluation of resistance to stress corrosion cracking, both end portions of the test specimen in the longitudinal direction were maintained from the lower surface side and simultaneously, the central portion thereof in the longitudinal direction is pressurized downward from the upper surface side, by maintaining each test specimen on a three-point bending jig, and a predetermined stress was applied on each test specimen. Further, the test specimen while being maintained on the three-point bending jig was exposed to ammonia in a desiccator in accordance with Japan Brass Makers Association Standard JBMA-01. Moreover, the tensile strengths before and after the exposure were compared and a test specimen having a strength reduction ratio of 50% or higher was evaluated as "○" for the resistance to stress corrosion cracking and a test specimen having a strength reduction ratio of less than 50% was evaluated as "x" for the resistance to stress corrosion cracking.

For the evaluation of cold workability, when a test specimen subjected to cold rolling with a predetermined working ratio was visually observed, a specimen on which cracks did not occur was evaluated as "○" and a specimen on which cracks occurred was evaluated as "x". For the evaluation of strength, a Vickers hardness measurement was performed, and as a result, a specimen having a hardness of Hv80 or higher was evaluated as "○" and a specimen having a hardness of less than Hv80 was evaluated as "x".

Figure 9:
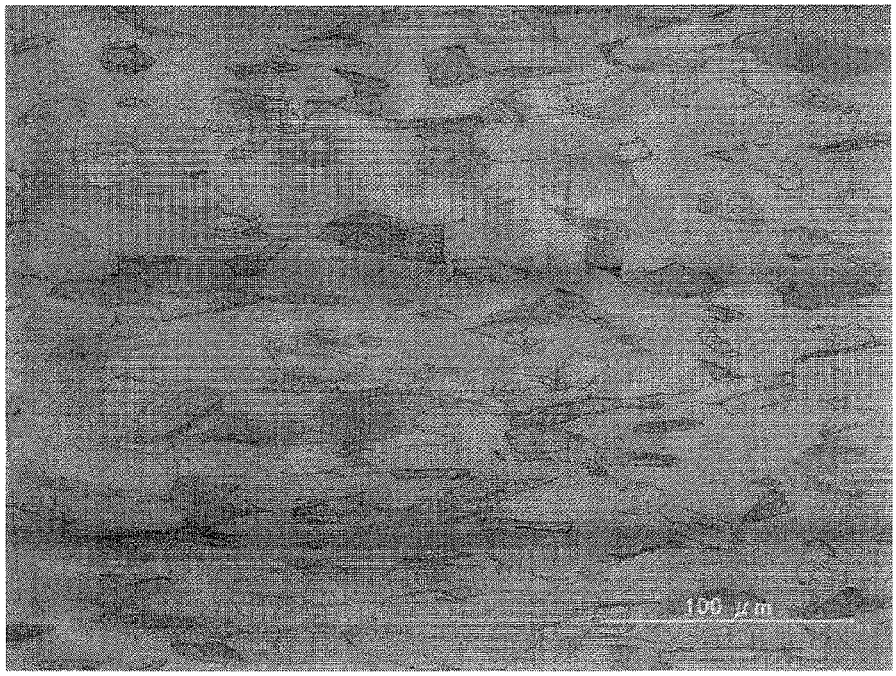
FIG. 9 is a copy of an optical microscope photo obtained by observing the structure of a cutting plane which is perpendicular to the rolling surface of a test specimen according to Example 2 and perpendicular to the rolling direction.
Figure 10:
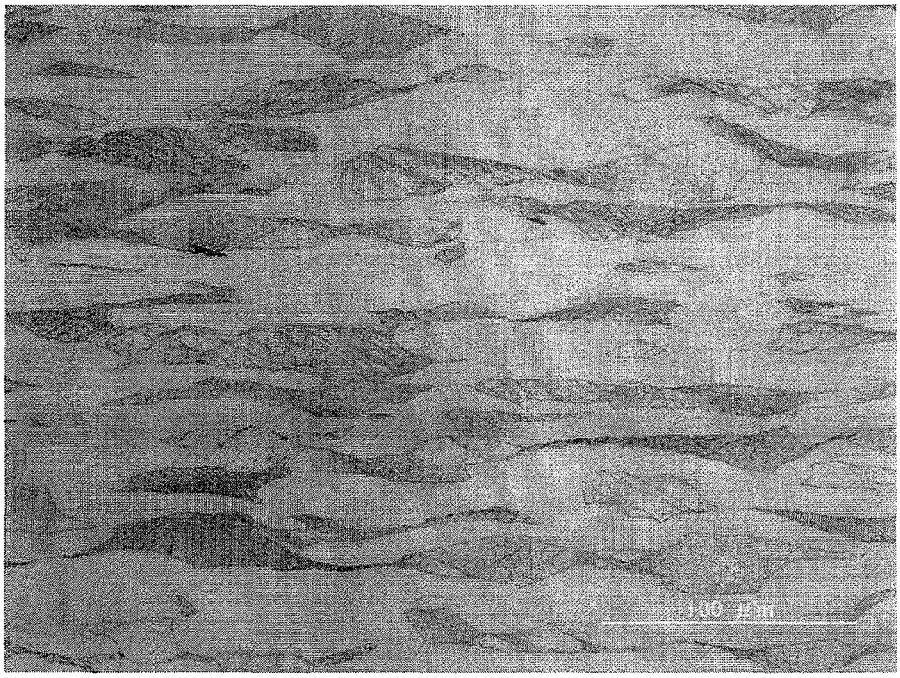
FIG. 10 is a copy of an optical microscope photo obtained by observing the structure of a cutting plane which is perpendicular to the rolling surface of a test specimen according to Example 2 and parallel to the rolling direction.
Figure 11:
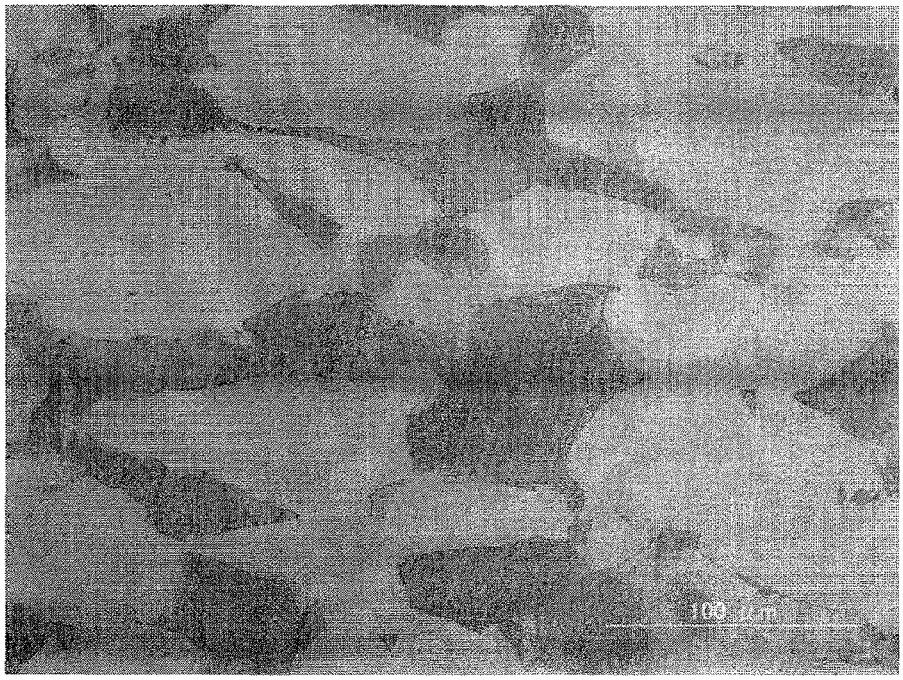
FIG. 11 is a copy of an optical microscope photo obtained by observing the structure of a cutting plane which is parallel to the rolling surface of a test specimen according to Example 2.

In the following Tables 1 and 2, manufacturing conditions of each test specimen according to the Examples and Comparative Examples are shown, and results of the ratio of the length of the long side to the length of the short side in the crystal grains of the β-phase and evaluation results of resistance to season cracking, resistance to stress corrosion cracking, cold workability, and strength are shown. In addition, for the test specimen of Example 2, copies of the photos obtained by observing the structure of the copper-zinc alloy in the cutting planes 26 to 28 with a scanning electron microscope are illustrated in FIGS. 9 to 11, respectively. Furthermore, in the copies of photos illustrated in FIGS. 9 to 11, shaded parts indicate the crystal grains of the β-phase.

TABLE 1

| | Zinc content (wt %) | Ratio of β-phase | Working ratio (%) | Stress relief annealing | β Length ratio of long side of β-phase | Resistance to season cracking | Resistance to stress corrosion cracking | Cold workability | Strength |
|---|---|---|---|---|---|---|---|---|---|
| Example 1 | 40 | 30 | 80 | None | 5 | ○ | ○ | ○ | ○ |
| Example 2 | 40 | 23 | 60 | None | 2 | ○ | ○ | ○ | ○ |
| Example 3 | 41 | 35 | 50 | None | 2 | ○ | ○ | ○ | ○ |
| Example 4 | 39 | 15 | 80 | None | 8 | ○ | ○ | ○ | ○ |

TABLE 2

| | Zinc content (wt %) | Ratio of β-phase | Working ratio (%) | Stress relief annealing | Length ratio of long side of β-phase | Resistance to stress corrosion cracking | Resistance to stress corrosion cracking | Cold workability | Strength |
|---|---|---|---|---|---|---|---|---|---|
| Comparative Example 1 | 40 | 10 | 60 | None | 5 | X | X | ○ | ○ |
| Comparative Example 2 | 45 | 70 | 10 | None | 1 | X | X | X | ○ |
| Comparative Example 3 | 15 | 0 | 80 | None | — | ○ | ○ | ○ | ○ |
| Comparative Example 4 | 30 | 0 | 80 | None | — | X | X | ○ | ○ |
| Comparative Example 5 | 35 | 0 | 80 | None | — | X | X | ○ | ○ |

As shown in the Table 1, all the test specimens of Examples 1 to 4 are higher than 35% by weight in zinc content, and thus effects of reducing costs caused by reduction in copper content in the copper-zinc alloy may be expected. Furthermore, the test specimens in Examples 1 to 4 were not subjected to annealing treatment but to cold rolling with a working ratio of 50% or higher, however, it was known that cracks were not observed on the surface of the test specimen and the cold workability was excellent.

Further, for the test specimens of Examples 1 to 4, the structure in a region in the vicinity of the pressure contact surface was observed at the above-described cutting plane 26 and cutting plane 27, and as a result, as illustrated in FIGS. 9 and 10, it could be confirmed that the crystal grains of the β-phase having a flat shape were arranged in a layer shape even in all the test specimens. In addition, for the test specimens in Examples 1 to 4, it was also confirmed that resistance to season cracking, resistance to stress corrosion cracking, and strength were sufficiently excellent.

Furthermore, the color tone of the test specimens in Examples 1 to 4 was decided in the Lab color system, and it could be confirmed that all the specimens had an L value of from 60 to 90, an a value of from 0 to 5, a b value of from 15 to 35 and included the same color as the color of the fastener element in the related art.

On one hand, as shown in the Table 2, in the test specimen in Comparative Example 1, the zinc content was adjusted to a predetermined range, but the ratio of the β-phase in the copper-zinc alloy was 100 or less. For this reason, for the test specimen in Comparative Example 1, it was confirmed that the effect of improving resistance to season cracking obtained by the crystal grains of the β-phase having a flat shape could not be sufficiently obtained.

In the test specimen in Comparative Example 2, a zinc content was higher than 43% by weight, and thus the β-phase in the copper-zinc alloy was present in a large amount and the ratio of the β-phase was 40% or higher. As described above, it was confirmed that as the ratio of the β-phase increases, the cold workability of the copper-zinc alloy was reduced, and cracks (brittle fracture) caused by a cold working with a working ratio of approximately 10% occurred on the copper-zinc alloy.

Further, the test specimen in Comparative Example 2 could not be subjected to cold working with a working ratio of 50% or higher, and thus the crystal grains of the β-phase could not be crushed into a flat shape, and the ratio of the length of the long side to the length of the short side in the crystal grains of the β-phase was less than 2. For this reason, the effects of improving resistance to season cracking and to stress corrosion cracking obtained by the crystal grains of the β-phase having a flat shape could not be sufficiently obtained.

The test specimen in Comparative Example 3 is a test specimen which was manufactured under the conditions approximately the same as those of the fastener element that has been generally produced in the related art. The resistance to season cracking, resistance to stress corrosion cracking, cold workability, and strength in the test specimen in Comparative Example 3 were at a level which may be withstood at the use of the slide fastener, but there was a problem in that the zinc content was low and the copper content was high, and thus the material costs were increased.

All of the test specimens in Comparative Examples 4 and 5 had a single phase structure of the α-phase, and were inferior in any one property of resistance to season cracking, resistance to stress corrosion cracking, and strength.

Next, fastener elements were produced according to the conditions of Examples 1 and 4 shown in the Table 1 and the conditions of Comparative Examples 3 and 5 shown in the Table 2, and each fastener element obtained was subjected to evaluations related to resistance to season cracking, resistance to stress corrosion cracking, cold workability, and strength.

Specifically, first, copper and zinc weighed were dissolved in a predetermined composition shown in Tables 1 and 2 to cast a billet, and a long wire rod was manufactured by subjecting the billet to wire drawing at normal temperature. Next, the long wire rod was subjected to heat treatment to control the ratio of the β-phase in the copper-zinc alloy to have a value that is shown in Table 1 and Table 2.

Subsequently, a Y bar 20 was molded by processing the long wire rod manufactured at normal temperature through a plurality of rolling mill rolls, such that the transverse cross-section of the wire rod is approximately a Y shape, and then a fastener element 10 was produced by slicing the Y bar 20 obtained into a predetermined thickness and subjecting the sliced element material 21 to press working with a forming punch or a forming die.

Next, the structure in a region in the vicinity of the internal side surface 10*d* of the leg portion in the fastener elements 10 in Examples 1 and 4 and Comparative Examples 3 and 5 was observed with a cross-sectional photo. Further, with respect to the fastener elements 10 in Examples 1 and 4 and Comparative Examples 3 and 5, evaluations related to resistance to season cracking, resistance to stress corrosion cracking, cold workability, and strength were performed by using the above-described method.

Here, for the fastener element 10 in Example 1, copies of the photos obtained by observing the structure in a region in the vicinity of the internal side surface 10*d* of the leg portion and the structure in a region in the vicinity of the internal side surface 10*e* of the crotch portion with a scanning electron microscope are illustrated in FIGS. 12 and 13, respectively. In addition, in copies of the photos illustrated in FIGS. 12 and 13, parts shown as black are the crystal grains of the β-phase.

The fastener elements 10 in Examples 1 and 4 were plastically deformed as the annealing treatment was not performed and a cold processing with a working ratio of 50% or higher was performed when the fastener element 10 was produced from the billet, but it was known that cracks were not observed on the surface of the fastener element 10 and the cold workability was excellent as in the evaluation results in the test specimen.

In addition, for the fastener elements 10 in Examples 1 and 4, the structures in a region in the vicinity of the internal side surface 10*d* of the leg portion and a region in the vicinity of the internal side surface 10*e* of the crotch portion were observed, and as a result, as illustrated in FIGS. 12 and 13, it could be confirmed that even in all the fastener elements 10, the crystal grains of the β-phase having a flat shape are arranged in a layer shape. Furthermore, it was also confirmed that the fastener elements 10 in Examples 1 and 4 are sufficiently excellent in resistance to season cracking, resistance to stress corrosion cracking, and strength as in the evaluation results in the test specimen.

The resistance to season cracking, resistance to stress corrosion cracking, cold workability, and strength in the fastener element in Comparative Example 3 were at a level, which may be withstood at the use of the slide fastener as in the evaluation results in the test specimen, but there was a problem in that the zinc content was low and the copper content was high, and thus the material costs were increased.

The fastener element in Comparative Example 5 had a single phase structure of the α-phase and was inferior in resistance to season cracking and to stress corrosion cracking.

DESCRIPTION OF REFERENCE NUMERALS

1 Slide fastener
2 Fastener stringer
3 Fastener tape
3*a* Core thread portion
4 Element row
5 Upper stopper
5*a* Flat square material
6 Lower stopper
6*a* Heteromorphic wire rod
7 Slider
10 Fastener element
10*a* Coupling head

10*b* Body portion
10*c* Leg portion
10*d* Internal side surface of leg portion
10*e* Internal side surface of crotch portion
10*f* External side surface
10*g* End surface
15 Crystal grains of β-phase
20 Wire rod (Y bar)
21 Element material
22 Direction perpendicular to rolling surface
23 Direction parallel to rolling direction
24 Direction perpendicular to rolling direction
25 Test specimen (Alloy foil)
26 Cutting plane
27 Cutting plane
28 Cutting plane
29 Rolling surface
31 to 36 Crystal grains of β-phase

The invention claimed is:

1. A copper-zinc alloy product including a copper-zinc alloy containing zinc in an amount of higher than 35% by weight and 43% by weight or less and having a two-phase structure composed of an α-phase and a β-phase, wherein the copper-zinc alloy product is a fastener component part, the fastener component part includes a fastener element having a coupling head, a body portion extending from the coupling head, and a pair of leg portions divergently extending from the body portion, a ratio of the β-phase in the copper-zinc alloy is higher than 10% and less than 40% and crystal grains of the α-phase and the β-phase are crushed into a flat shape and arranged in a layer shape, and the crystal grains of the α-phase and β-phase having the flat shape are arranged along an internal side surface of each of the leg portions.

2. The copper-zinc alloy product according to claim 1, wherein the crystal grains of the β-phase having the flat shape are formed in the layer shape in a direction intersecting a direction in which cracks caused by season cracking due to residual stress or cracks caused by stress corrosion cracking progress.

3. The copper-zinc alloy product according to claim 1, wherein the crystal grains of the α-phase and β-phase having the flat shape are arranged along an external surface of the copper-zinc alloy product.

4. The copper-zinc alloy product according to claim 3, wherein the crystal grains of the β-phase having the flat shape are formed such that a ratio of a length of a long side in a direction parallel to the external surface to a length of a short side in a direction perpendicular to the external surface is 2 or higher, when viewed in cross section.

5. The copper-zinc alloy product according to claim 1, wherein the copper-zinc alloy product includes an intermediate product.

6. The copper-zinc alloy product according to claim 1, wherein an internal side surface of a crotch portion connecting the internal side surfaces of the leg portions is disposed at the body portion and the α-phase and β-phase having the flat shape are arranged along the internal side surface of the crotch portion of the body portion.

7. A copper-zinc alloy product including a copper-zinc alloy containing zinc in an amount of higher than 35% by weight and 43% by weight or less and having a two-phase structure composed of an α-phase and a β-phase, wherein the copper-zinc alloy product is a fastener component part, the fastener component part is a stopper which is attached to a fastener tape of a slide fastener, a ratio of the β-phase in the copper-zinc alloy is higher than 10% and less than 40% and crystal grains of the α-phase and the β-phase are crushed into a flat shape and arranged in a layer shape, and the α-phase and β-phase having the flat shape are arranged along an internal side surface of the stopper to be in contact with the fastener tape.

8. A process for producing a copper-zinc alloy product, wherein the copper-zinc alloy product is a fastener component part, the fastener component part includes a fastener element having a coupling head, a body portion extending from the coupling head, and a pair of leg portions divergently extending from the body portion, including:

a step of controlling a ratio of a β-phase in a copper-zinc alloy containing zinc in an amount of higher than 35% by weight and 43% by weight or less and having a two-phase structure composed of an α-phase and the β-phase to be higher than 10% and less than 40%;

a step of subjecting the copper-zinc alloy with the ratio of the β-phase controlled to a cold working with a working ratio of 50% or more to crush crystal grains of the α-phase and the β-phase into a flat shape and arrange them in a layer shape through cold working; and a step of arranging the crystal grains of the α-phase and the β-phase having the flat shape along an internal side surface of each of the leg portions.

9. The process for producing a copper-zinc alloy product according to claim 8, wherein the step of controlling the ratio of the β-phase includes subjecting the copper-zinc alloy to heat treatment.

10. The process for producing a copper-zinc alloy product according to claim 8, wherein the process includes forming the crystal grains of the β-phase having the flat shape in the layer shape in a direction intersecting a direction in which cracks caused by season cracking due to residual stress or cracks caused by stress corrosion cracking progress, through the cold working.

11. The process for producing a copper-zinc alloy product according to claim 8, wherein the process includes forming the crystal grains of the β-phase through the cold working such that a ratio of a length of a long side in a direction parallel to an external surface of the copper-zinc alloy product to a length of a short side in a direction perpendicular to the external surface thereof is a predetermined size, when viewed in cross section.

12. The process for producing a copper-zinc alloy product according to claim 11, wherein the process includes forming the crystal grains of the β-phase such that a ratio of the length of the long side to the length of the short side is 2 or higher, when viewed in cross section.

13. The process for producing a copper-zinc alloy product according to claim 8, wherein an intermediate product is produced as the copper-zinc alloy product.

14. The process for producing a copper-zinc alloy product according to claim 8, wherein the fastener component part is produced by forming a long wire rod or a plate from the copper-zinc alloy and cutting or punching the wire rod or the plate.

15. The process for producing a copper-zinc alloy product according to claim 14, wherein the fastener element product includes a stopper.

* * * * *

UNITED STATES PATENT AND TRADEMARK OFFICE

CERTIFICATE OF CORRECTION

PATENT NO. : 9,023,272 B2
APPLICATION NO. : 13/808298
DATED : May 5, 2015
INVENTOR(S) : Yoshimura et al.

It is certified that error appears in the above-identified patent and that said Letters Patent is hereby corrected as shown below:

In the Specification

Column 10, line 40, delete "u-phase" and insert -- μ-phase --, therefor.

Column 10, line 62, delete "an" and insert -- and --, therefor.

Column 13, line 8, delete "a of" and insert -- of --, therefor.

Column 13, line 17, delete "a of" and insert -- of --, therefor.

Column 13, line 25, delete "a of" and insert -- of --, therefor.

Column 13, line 27, delete "a of" and insert -- of --, therefor.

Column 13, line 29, delete "a of" and insert -- of --, therefor.

Column 13, line 37, delete "a of" and insert -- of --, therefor.

Column 15, line 24, delete "13-phase" and insert -- β-phase --, therefor.

Column 19, line 8, delete "an" and insert -- and --, therefor.

Signed and Sealed this
Fifteenth Day of September, 2015

Michelle K. Lee

Michelle K. Lee
*Director of the United States Patent and Trademark Office*